United States Patent [19]

Sims

[11] Patent Number: 5,020,422

[45] Date of Patent: Jun. 4, 1991

[54] PISTON/CYLINDER ASSEMBLY

[76] Inventor: James O. Sims, 1100 Brooks St., Decatur, Ala. 35601

[21] Appl. No.: 471,627

[22] Filed: Jan. 29, 1990

[51] Int. Cl.[5] ..... F01B 1/00

[52] U.S. Cl. ..... 92/146; 92/165 R

[58] Field of Search ..... 92/146, 152, 161, 165 R, 92/166, 165 PR, 13.4, 13.41; 91/508, 520, 170 R, 170 MP

[56] References Cited

U.S. PATENT DOCUMENTS

| | | | |
|---|---|---|---|
| 1,687,369 | 10/1928 | LaPointe | 92/146 |
| 2,240,287 | 4/1941 | Croll, Jr. | 92/165 |
| 2,482,023 | 9/1949 | Opitz | 92/146 |
| 2,747,372 | 5/1956 | York | 92/146 |
| 3,099,187 | 7/1963 | Hoza | 92/146 |
| 3,158,070 | 11/1964 | Olson | 92/146 |
| 4,128,380 | 12/1978 | Jamann | 91/508 |
| 4,394,875 | 7/1983 | Weirich et al. | 91/170 MP |
| 4,412,476 | 11/1983 | Benaroya | 92/146 |
| 4,748,894 | 6/1988 | Foster | 91/520 |
| 4,759,263 | 7/1988 | Lehle | 92/13.41 |

FOREIGN PATENT DOCUMENTS

| | | | |
|---|---|---|---|
| 0082805 | 6/1980 | Japan | 92/165 PR |
| 8005507 | 5/1982 | Netherlands | 92/146 |
| 0969985 | 10/1982 | U.S.S.R. | 92/165 R |
| 454180 | 9/1936 | United Kingdom | 92/146 |

*Primary Examiner*—Edward K. Look
*Assistant Examiner*—Thomas Denion
*Attorney, Agent, or Firm*—Phillips & Beumer

[57] ABSTRACT

A compact lightweight piston/cylinder assembly having a body provided with a plurality of adjacent chambers, each chamber having a piston reciprocally mounted therein. Each piston is secured to a piston guide member which reciprocally moves in the body with each of the pistons. One of the pistons serves as an output piston and is provided with a piston rod extending therefrom.

13 Claims, 2 Drawing Sheets

PISTON/CYLINDER ASSEMBLY

TECHNICAL FIELD

This invention relates generally to fluid operated cylinders and more particularly to a multi-chamber, multi-piston fluid operated piston/cylinder assembly.

BACKGROUND OF THE INVENTION

Typical piston/cylinder assemblies include a cylindrical housing and cylinder heads for enclosing a piston therein. A poston rod typically extends axially from the piston for engagement with a workpiece. Where substantially large pressures are required to move the piston, the cylinder, cylinder heads, piston, and piston rod (s) are accordingly made thicker and heavier, thus increasing the size and weight of the assembly. Such increased size and weight are detrimental in cases wherein space is critical.

In some cases, where small strokes of the piston can be tolerated in an effort to decrease the size and weight of the piston assembly, metallic pistons have been replaced by lightweight diaphragms. However, diaphragms are susceptible of being punctured. Evan a small puncture is detrimental since even small leakages cannot be tolerated in such assemblies.

SUMMARY OF THE INVENTION

In accordance with this invention, a piston/cylinder assembly includes a substantially flat body comprised of spaced head and cap members, each having a plurality of alighned adjacent piston chambers therein. Each chamber is provided with a piston reciprocally mounted therein, and each piston is connected to a common guide member which is movable between the head and cap members. In let and outlet means are provided to direct fluid pressure into and out of the chambers.

It is an object of the present invention, therefore, to provide a small, compact piston/cylinder assembly which overcomes the above-noted difficulties of the prior art devices.

It is another object of the present invention to provide such a piston/cylinder assembly with a cylinder having multiple chambers each having a piston reciprocally movable therein.

It is a further object of the present invention to provide such a cylinder with a configuration which provides for installation of the piston/cylinder assembly in confined spaces.

DESCRIPTION OF THE PREFERRED EMBODIMENT

Figure 1:
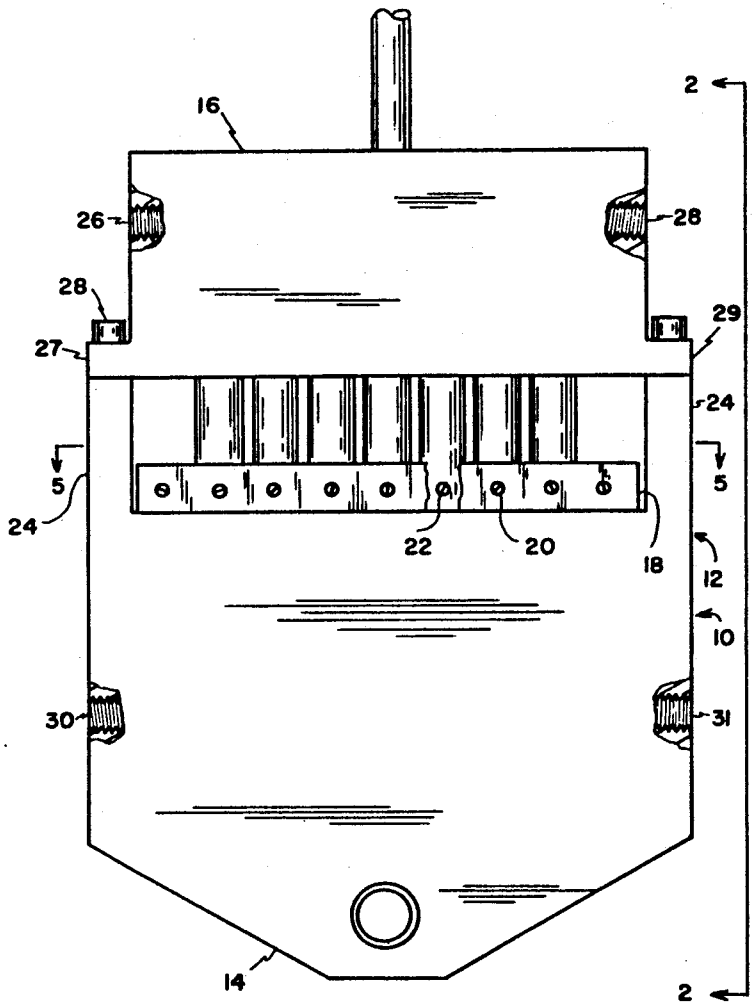
FIG. 1 is an elevational view of the piston/cylinder assembly of the present invention.
Figure 2:
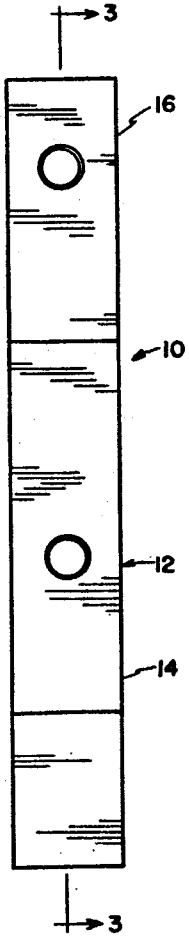
FIG. 2 is an elevational view taken along line 2—2 of FIG. 1.

As seen in FIGS. 1 and 2, a piston/cylinder assembly 10 includes a substantially flat cylinder housing 12 comprised of a cap 14 and a head 16 secured together and housing a plurality of pistons (FIG. 3) therein. The assembly includes a piston guide 18 secured to and movable with the pistons. Each piston is connected to guide member 18 by screws or bolts 20 which extend through openings 22 and 23 in the pistons and in the guide member 18, respectively. Nuts (not shown) may be used to secure the bolts to the pistons and guide member.

To provide a space for piston guide member 18 to be movably mounted in the cylinder with the pistons, a pair of upwardly extending portions of cap 14 form spacers 24 between cap 14 and head 16, Screws 28 extend through flanged portions 27 and 29 of member 16 and into tapped openings 33 and 35 in members 14 and secure the cap and head together. The length of the spacers defines the stroke of the pistons.

Figure 3:
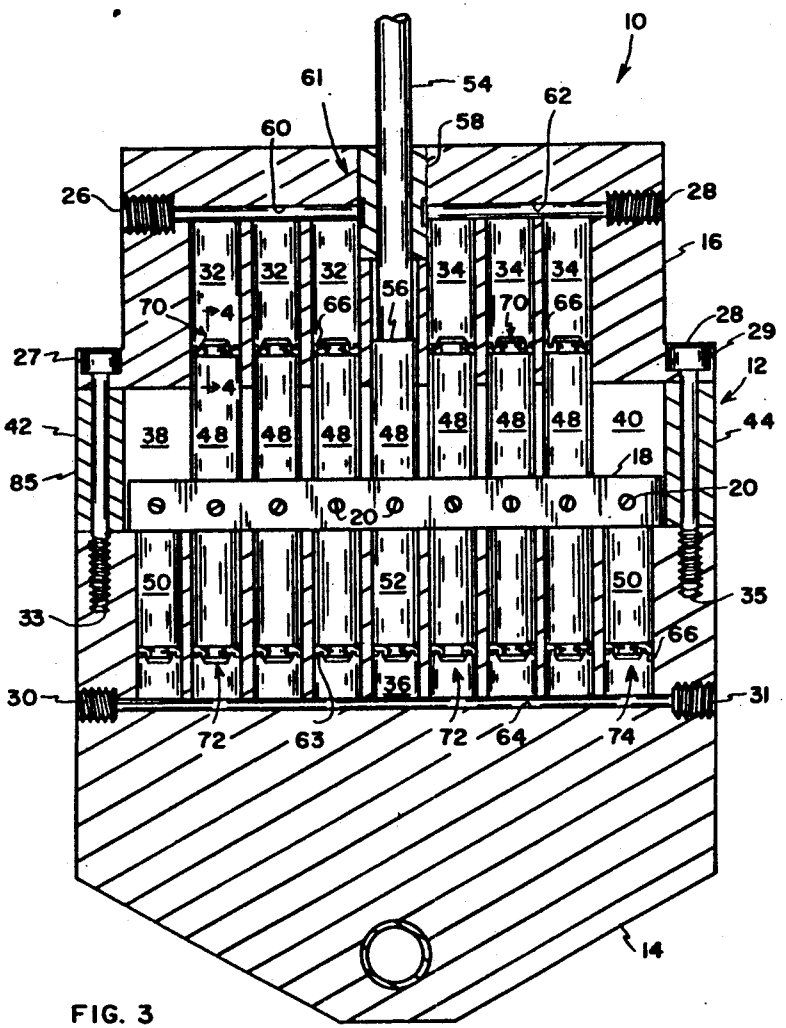
FIG. 3 is a sectional view taken along line 3—3 of FIG. 2.

As seen in FIG. 3, housing 12 includes a pair of inlet openings 26 and 28 and a pair of outlet openings 30 and 31 which serve to direct the fluid to and from the individual chambers in which the pistons are reciprocally mounted. FIG. 3 shows the housing to contain six chambers (more or less chambers may be used, as desired) designated by the numerals 32 and 34, with three of these chambers (32) being on one side of a central chamber 36 and the other three (34) being on the opposite side of central chamber 36. A pair of shorter chambers 38 and 40 are provided in the cylinder housing, with chamber 38 positioned adjacent to side 42 and chamber 40 positioned adjacent to side 44 of body 12.

Positioned in chambers 32 and 34 are pistons of the same length designated by the numeral 48. Shorter pistons 50 are positioned in chambers 38 and 40, and an output piston 52 having a piston rod 54 secured to the end 56 thereof is positioned in central chamber 36. A rod bearing 58 is disposed around piston rod 54 in the area 61 where the rod exits the cylinder assembly.

It is to be understood that while openings 26, 28 and 30, 31 are respectively designated as inlet and outlet openings, they may be reversed, and openings 30 and 31 may be the inlet and openings 26 and 28, the outlets. In any event, as seen in FIG. 3, opening 26 is in communication with a passageway 60 which, in turn, is in communication with cylinder chambers 32. Opening 28 is in communication with a passageway 62 which is, in turn, in communication with cylinder chambers 34. Openings 30 and 31 are in communication with a passageway 64 which is, in turn, in communication with all of the chambers 32, 34, 36, 38, and 40 of the housing.

Figure 4:
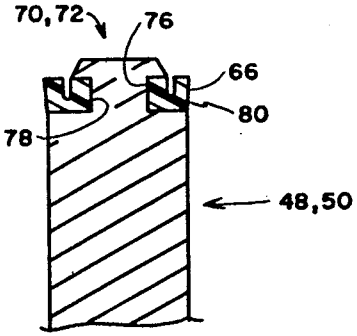
FIG. 4 is an enlarged view illustrating the piston seals for sealing against fluid leakage in the cylinder.

As can be seen in FIGS. 3 and 4, each of pistons 32 and 34 includes a rubber skirt (seal) 66 disposed at the ends 70 and 72 thereof. The seals 66 are provided only at one end 74 of pistons 50. Each of the pistons include an offset portion 76 to receive the easily removably seals 66 therein. The seals include a gripping inner annular surface 78 (FIG. 4 ) and an outer skirt portion 80.

Figure 5:
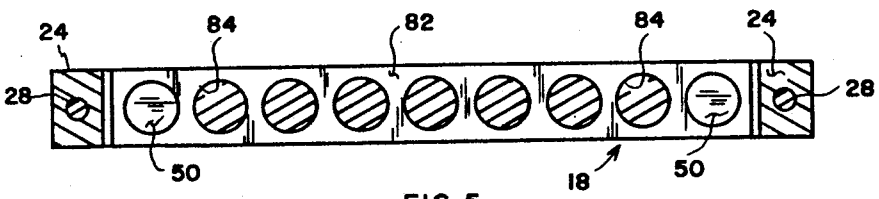
FIG. 5 is a sectional view taken along line 5—5 of FIG. 1.

Piston guide 18 is more clearly shown in FIG. 5 to include an elongated body 82 having a plurality of openings 84 extending therethrough. Each of the openings receives a piston in secured relation therein, and screws 20 are used to secure the pistons in the openings, as described supra.

FIG. 3 is a view similar to FIG. 1 showing another embodiment of the housing of the present invention wherein like numerals refer to like parts. FIG. 3 illustrates a pair of removable spacers 85 positioned between the cap member 14 and head 16. Screws 28 are shown to extend through flanged portions 27 and 29 of head 16, through openings in spacers 85, and into tapped openings 33 and 35 of cap member 14. The height of the spacer determines the stroke of the pistons.

As can be seen in FIGS. 1 and 3, the opening or space between cap member 14 and head 16 permits the pistons to be visually observed, thus providing a means whereby the assembly may be monitored for leakage. It is to be understood that it is possible for the assembly shown to tolerate a certain amount of leakage as the device will continue to function with a few of the chambers leaking.

It is to be understood that the piston/cylinder assembly of the present invention may be made of lightweight material such as aluminum or plastic since it operates without concentrated pressure, i.e., the pressure is spread over a plurality of piston faces.

I claim:

1. A piston/cylinder assembly comprising:

a substantially flat housing having a plurality of piston receiving chambers therein in side-by-side relation, said housing having lower and upper sections and an elongated space between said sections;

a piston reciprocally mounted in said chambers, each said piston having sealing means for effecting a fluid seal with said housing;

a piston guide member secured to each of said pistons intermediate the ends thereof for providing corresponding reciprocal movement of said pistons, said guide member disposed in said space between said lower and upper sections first passage means communicating into said chambers for directing fluid pressure into or out of said chambers;

second passage means communicating into said chambers for directing fluid pressure into or out of said chambers; and output means operatively connected to said pistons for transferring said reciprocal movement thereof out of said housing.

2. A piston/cylinder assembly as set forth in claim 1 wherein said piston guide member is provided with a plurality of openings to receive said pistons therein in secured relation.

3. A piston/cylinder assembly as set forth in claim 1 wherein said plurality of chambers in said housing includes a central chamber, and wherein said output means is an output piston mounted in said central chamber, said output piston being provided with a piston rod extending therefrom.

4. A piston/cylinder assembly as set forth in claim 3 wherein said lower and upper sections of said housing are respectively comprised of a cap member and a head member having a spacer member disposed therebetween to maintain said cap member and said head member in predetermined spaced relation, the spacing between said cap member and said head member defining the stroke of said pistons.

5. A piston/cylinder assembly as set forth in claim 4 wherein said side-by-side chambers include lower portions disposed in said cap member and upper portions disposed in said head member, said lower and upper portions disposed in aligned relation, said piston guide member movably disposed in a central chamber between said cap member and said head member.

6. A piston/cylinder assembly as set forth in claim 5 wherein said chambers are symmetrically arranged in said housing with a first set of said plurality of chambers disposed on a first side of said central chamber and a second set of said chambers disposed on a second side of said central chamber.

7. A piston/cylinder assembly as set forth in claim 6 wherein said first passage means includes a first passageway communicating into said first set of chambers and said second passageway means communicating into said second set of chambers.

8. A piston/cylinder assembly as set forth in claim 7 wherein said first passage means is disposed in said head member.

9. A piston/cylinder assembly as set forth in claim 7 wherein said second passage means is disposed in said cap member.

10. A piston/cylinder assembly as set forth in claim 2 wherein said output means includes an output member secured to said piston guide member.

11. A piston/cylinder assembly as set forth in claim 2 wherein said sealing means is a flexible sealing member disposed on said pistons for sealing relation thereof within said chambers.

12. A piston/cylinder assembly as set forth in claim 4 wherein each end of said pistons which is positioned in said head and cap members is provided with said sealing member thereon.

13. A piston/cylinder assembly as set forth in claim 4 wherein said spacer member is removably attached between said head and said cap member.

* * * * *